US010900290B2

(12) United States Patent
Howard et al.

(10) Patent No.: US 10,900,290 B2
(45) Date of Patent: Jan. 26, 2021

(54) FIXED CUTTER COMPLETIONS BIT

(71) Applicant: VAREL INTERNATIONAL IND., L.L.C., Carrollton, TX (US)

(72) Inventors: Johnathan Walter Howard, Conroe, TX (US); Matthew Charles Stroever, Spring, TX (US); Jeffery Lewayne Johnson, Cypress, TX (US); Charles Daniel Johnson, Porter, TX (US)

(73) Assignee: VAREL INTERNATIONAL IND., L.L.C., Carrollton, TX (US)

( * ) Notice: Subject to any disclaimer, the term of this patent is extended or adjusted under 35 U.S.C. 154(b) by 0 days.

(21) Appl. No.: 16/444,722

(22) Filed: Jun. 18, 2019

(65) Prior Publication Data

US 2020/0003014 A1 Jan. 2, 2020

Related U.S. Application Data

(60) Provisional application No. 62/692,134, filed on Jun. 29, 2018.

(51) Int. Cl.

| | |
|---|---|
| ***E21B 10/43*** | (2006.01) |
| ***E21B 12/04*** | (2006.01) |
| ***E21B 10/60*** | (2006.01) |
| ***E21B 10/55*** | (2006.01) |
| ***E21B 10/50*** | (2006.01) |

(52) U.S. Cl.

CPC ..... *E21B 10/43* (2013.01); *E21B 10/50* (2013.01); *E21B 10/55* (2013.01); *E21B 10/602* (2013.01); *E21B 12/04* (2013.01)

(58) Field of Classification Search

CPC ..... E21B 10/55

See application file for complete search history.

(56) References Cited

U.S. PATENT DOCUMENTS

| | | | | |
|---|---|---|---|---|
| 3,268,274 | A * | 8/1966 | Ortloff | E21B 17/1078 175/325.4 |
| 5,038,859 | A | 8/1991 | Lynde et al. | |
| 6,170,576 | B1 | 1/2001 | Brunnert et al. | |
| 6,568,492 | B2 | 5/2003 | Thigpen et al. | |
| 7,325,631 | B2 | 2/2008 | Roberts et al. | |
| 7,958,940 | B2 | 6/2011 | Jameson | |
| 9,951,563 | B2 | 4/2018 | Beaton et al. | |
| 10,280,691 | B2 | 5/2019 | Wendt et al. | |
| 2012/0080240 | A1* | 4/2012 | Green | B24D 99/005 175/428 |

(Continued)

OTHER PUBLICATIONS

Torquato; Plugbuster XLR; Lower Your Completion Costs With a Plugbuster Milling Bit; Mar. 1, 2017; http://www.torquato.com/products/plugbuster-bits.html.

*Primary Examiner* — Giovanna Wright
*Assistant Examiner* — Dany E Akakpo

(57) ABSTRACT

A completions bit for use in a wellbore includes: a shank having a coupling formed at an upper end thereof; a body mounted to a lower end of the shank; and a cutting face forming a lower end of the bit. The cutting face includes: a blade protruding from the body; a tangentially oriented leading cutter mounted to a bearing face of the blade adjacent to a leading edge of the blade at an inner portion of the cutting face; and a radially oriented leading cutter mounted to the bearing face of the blade in proximity to the leading edge thereof at an outer portion of the cutting face.

17 Claims, 6 Drawing Sheets

(56) References Cited

U.S. PATENT DOCUMENTS

| | | | | |
|---|---|---|---|---|
| 2015/0060149 | A1 | 3/2015 | Herman et al. | |
| 2015/0233187 | A1* | 8/2015 | King | E21B 10/43 175/426 |
| 2017/0114597 | A1 | 4/2017 | Chevalier et al. | |
| 2018/0291689 | A1 | 10/2018 | Palmer et al. | |
| 2020/0001367 | A1* | 1/2020 | Duffy | C22C 26/00 |

* cited by examiner

FIXED CUTTER COMPLETIONS BIT

BACKGROUND OF THE DISCLOSURE

Field of the Disclosure

The present disclosure generally relates to a fixed cutter completions bit.

Description of the Related Art

U.S. Pat. No. 5,038,859 discloses a cutting tool for removing metal tubular members held in stationary position downhole from a well bore and adapted to be inserted within a well. The cutting tool includes a plurality of elongate blades on the cylindrical body of the cutting tool which extend below the bottom of the tool body. Cutting elements of a predetermined size and shape are arranged in a symmetrical predetermined pattern on the lower portion of each blade in a plurality of predetermined transversely extending rows below the tool body. The cutting elements in adjacent transverse rows for each blade are staggered horizontally and have different concentric cutting paths. Preferably, the cutting elements in corresponding transverse rows on adjacent blades are staggered and have different concentric cutting paths. Each cutting element has a groove for receiving and directing forwardly the extending end of a metal shaving to facilitate breaking thereof from the upper end of the tubular member being cut away. A high strength tungsten carbide alloy material is secured to the trailing surface of the blades to reinforce the blades in addition to assisting the cutting action.

U.S. Pat. No. 6,170,576 discloses a wellbore mill having a body with a top and a bottom and, optionally, a fluid flow channel extending therethrough from top to bottom with, optionally, one or more fluid jetting ports in fluid communication with the fluid flow channel, milling apparatus on the body including a plurality of milling inserts, each insert mechanically secured in a corresponding recess in the body, said mechanical securement sufficient for effective milling in a wellbore. The mill is used for milling an opening in a selected tubular of a tubular string in a wellbore.

U.S. Pat. No. 6,568,492 discloses a drag type casing mill/drill bit for down hole milling of a casing window and lateral drilling of a bore hole in an earth formation comprises a bit body adapted to be rotated in a defined direction. The bit body includes an operating end face having a plurality of radially extending blades formed as a part of the operating end face of the bit body. A plurality of primary cutting elements are individually mounted in pockets in one of the plurality of blades. In addition, a plurality of secondary ridge structures are mounted to each of the plurality of blades interspersed with the plurality of primary cutting elements in a pattern such that as the bit body rotates the secondary ridge structures contact the casing or the earth formation thereby protecting the primary cutting elements and allowing continuous substantially smooth casing milling and earth formation drilling.

U.S. Pat. No. 7,325,631 discloses a downhole mill including a plurality of cutters extending generally radially from a center region to a gage diameter, wherein the plurality of cutters includes a first serrated cutter blade having a plurality of peaks and valleys along its length. The plurality of cutters includes a second serrated cutter blade having a plurality of peaks and valleys along its length. The plurality of cutters includes a non-serrated cutter blade positioned upon the cutting face between the first serrated cutter blade and the second serrated cutter blade, wherein the peaks of the first serrated cutter blade is radially aligned with the valleys of the second serrated cutter blade. A pump-off sub configured to release a downhole mill includes a dovetail connection maintained by a c-ring in an expanded state.

U.S. Pat. No. 7,958,940 discloses a process to drill through a composite frac plug. The plug is in an oil well. The process utilizes an improved mill. The process also rotates drill pipe at one hundred to five hundred rpm and circulates drilling fluid such that the velocity of the fluid upwardly over the exterior of the drill pipe is in the range of three hundred to four hundred and seventy-five feet per minute. One thousand to three thousand pounds of slack off weight is applied during the process.

U.S. Pat. No. 9,951,563 discloses a mill including a mill body defining a plurality of blades extending in a direction from a center or rotation of the mill body to a gauge surface. The blades define a cutting profile having a minimum diameter at a longitudinal endmost position. The minimum diameter is smaller than a diameter of a drop ball. The cutting profile has an intermediate diameter at most equal to the diameter of the drop ball at a longitudinal distance from the endmost position greater than the diameter of the drop ball. Shear cutters are mounted on at least one of the plurality of blades, mounted such that at least one shear cutter is mounted closer to a center of rotation of the mill body with respect to other cutters mounted to the blades. At least one insert is mounted to the at least one of the plurality of blades rotationally ahead of the shear cutters.

US 2015/0060149 discloses a drill bit including a bit body defining a plurality of blades extending from a selected distance from an axis of rotation of the bit body to a gage face. A plurality of only gouging cutters is mounted on the bit body. At least one of the plurality of blades has a blade top surface longitudinally behind the tips of the gouging cutters at a selected distance from the tips of the gouging cutters.

US 2015/0233187 discloses a fixed cutter bit for milling a frac plug includes a body and a face. The face includes a base surface and a plurality of cutter support structures extending from the base surface. Each cutter support structure has a peripheral portion and an inner portion disposed radially internal of the peripheral portion. At least one first-type cutter is supported by each peripheral portion; at least one second-type cutter is supported by each inner portion. The first type cutter is adapted to mill a harder material than the second-type cutter, and the first-type is different from the second-type.

US 2017/0114597 discloses a concentric alignment device that elevates the working face of a drill bit off of the inner wall of a casing or tubing to prevent premature wear of the working face of the drill bit. In horizontal drilling applications, the working face of a drill bit has a tendency to contact or rest on the inner wall of a casing or tubing, which negatively affects the working face of a drill bit. In some embodiments, one or more optional inserts are provided on the shank of a drill bit or on a centralizing sub such that the inserts contact the inner wall of a casing or tubing instead of the working face of the drill bit. In other embodiments, blade packages on a drill bit or sub contact the inner wall of a casing or tubing and also pump drilling fluid in a downhole direction.

US 2018/0291689 discloses a drill bit including a cone section, a blade flank section, a blade shoulder section, and a plurality of blades connected to the bit body and extending away from the bit body. At least one cutting element is positioned on at least one of the plurality of blades. In addition, a plurality of thermally stable polycrystalline cutters is positioned on at least one of the plurality of blades in at least one of the cone section, the blade flank section, and the blade shoulder section of the at least one of the plurality of blades. The thermally stable polycrystalline cutters include a cutting edge that defines a line, wherein the line is substantially parallel to a tangent line of a radius line that extends from a center of the drill bit to the cutting edge.

SUMMARY OF THE DISCLOSURE

The present disclosure generally relates to a fixed cutter completions bit. In one embodiment, a completions bit for use in a wellbore includes: a shank having a coupling formed at an upper end thereof; a body mounted to a lower end of the shank; and a cutting face forming a lower end of the bit. The cutting face includes: a blade protruding from the body; a tangentially oriented leading cutter mounted to a bearing face of the blade adjacent to a leading edge of the blade at an inner portion of the cutting face; and a radially oriented leading cutter mounted to the bearing face of the blade in proximity to the leading edge thereof at an outer portion of the cutting face.

In another embodiment, a completions bit for use in a wellbore includes: a shank having a coupling formed at an upper end thereof; a body mounted to a lower end of the shank; and a cutting face forming a lower end of the bit. The cutting face includes: a blade protruding from the body; a first leading cutter mounted to a bearing face of the blade at an inner portion of the cutting face; a second leading cutter mounted to the bearing face of the blade at an outer portion of the cutting face; and a mill pad mounted to the bearing face of the blade, covering the bearing face along the inner and outer portions of the cutting face, and comprising a plurality of mill cutters, each mill cutter having a minimum dimension greater than or equal to $1/8^{th}$ of an inch.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
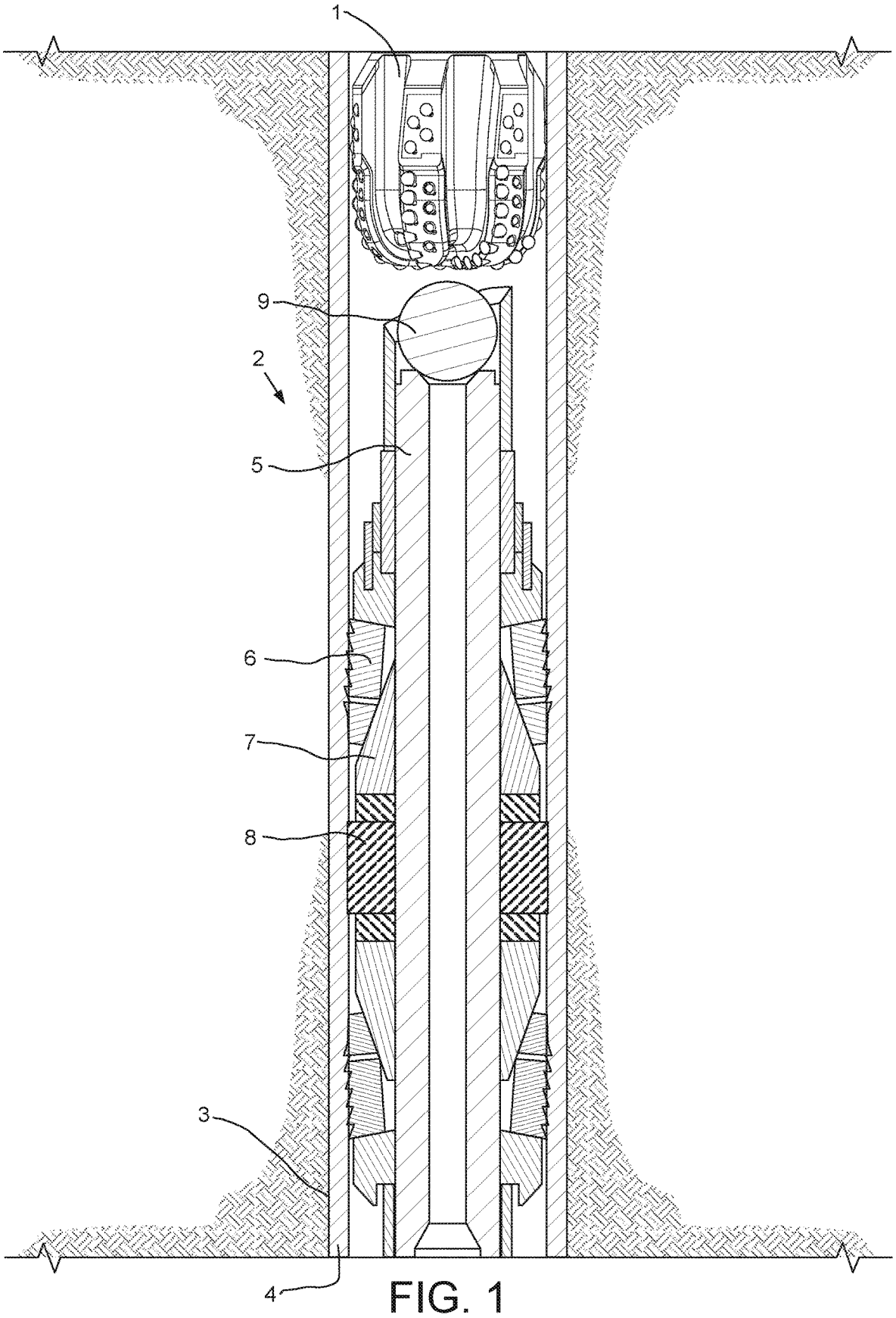
FIG. 1 illustrates a fixed cutter completions bit positioned for drilling out a frac plug set in a wellbore, according to one embodiment of the present disclosure.

FIG. 1 illustrates a fixed cutter completions bit 1 positioned for drilling out a frac plug 2 set in a wellbore 3, according to one embodiment of the present disclosure. For a hydraulic fracturing operation, the frac plug 2 is set against a casing or liner string 4 to isolate a zone (not shown) of a formation adjacent to the wellbore 3. To set the frac plug 2, a setting tool (not shown) and the frac plug may be deployed down the casing or liner string 4 using a wireline (not shown). The frac plug 2 may be set by supplying electricity to the setting tool via the wireline to activate the setting tool. A piston of the setting tool may move an outer portion of the frac plug 2 along a mandrel 5 of the frac plug while the wireline restrains a mandrel of the setting tool and the plug mandrel, thereby compressing a packing element 8 and driving slips 6 along respective slip cones 7 of the frac plug. The packing element 8 may be radially expanded into engagement with the casing or liner string 4 and the slips 6 may be wedged into engagement therewith.

The casing or liner string 4 may then be perforated above the set frac plug 2 and the isolated zone may be hydraulically fractured by pumping a ball 9 followed by fracturing fluid (not shown) down the casing or liner string 4. The ball 9 may land in a seat of the plug mandrel 5, thereby forcing the fracturing fluid into the zone via the perforations. Another frac plug (not shown) may then be set above the fractured zone and the casing or liner string 4 may again be perforated above the plug for hydraulic fracturing of another zone. This process may be repeated many times, such as greater than or equal to ten, twenty, or fifty times, until all of the zones adjacent to the wellbore 3 have been fractured.

After all of the zones have been fractured, a production valve at the wellhead may be opened to produce fluid from the wellbore in an attempt to retrieve the balls 9. The fixed cutter completions bit 1 (only partially shown) may be deployed down the casing or liner string 4 using coiled tubing (not shown). A drilling motor (not shown), such as a mud motor, may connect the fixed cutter completions bit 1 to the coiled tubing. The fixed cutter completions bit 1, drilling motor, and coiled tubing may be collectively referred to as a mill string. Milling fluid may be pumped down the coiled tubing, thereby driving the drilling motor to rotate the fixed cutter completions bit 1 and the fixed cutter completions bit may be advanced into engagement with the frac plug 2, thereby drilling out the frac plug. Once drilled out, the mill string may be advanced to drill out the next frac plug 2 until all of the frac plugs have been drilled out.

Alternatively, the mill string may include a string of drill pipe instead of coiled tubing with or without the drilling motor. Alternatively, the fixed cutter completions bit 1 may be employed to drill out other types of downhole tools, such as packers, bridge plugs, float collars, float shoes, stage collars, guide shoes, reamer shoes, and/or casing bits. Alternatively, the fixed cutter completions bit 1 may be assembled as part of a drill string for drilling the wellbore 3. Alternatively, the fixed cutter completions bit 1 may be assembled as part of a drill string for drilling a wellbore to an aquifer or for geothermal use. Alternatively, the fixed cutter completions bit 1 may be assembled as part of a drill string for drilling a blasthole.

Figure 2:
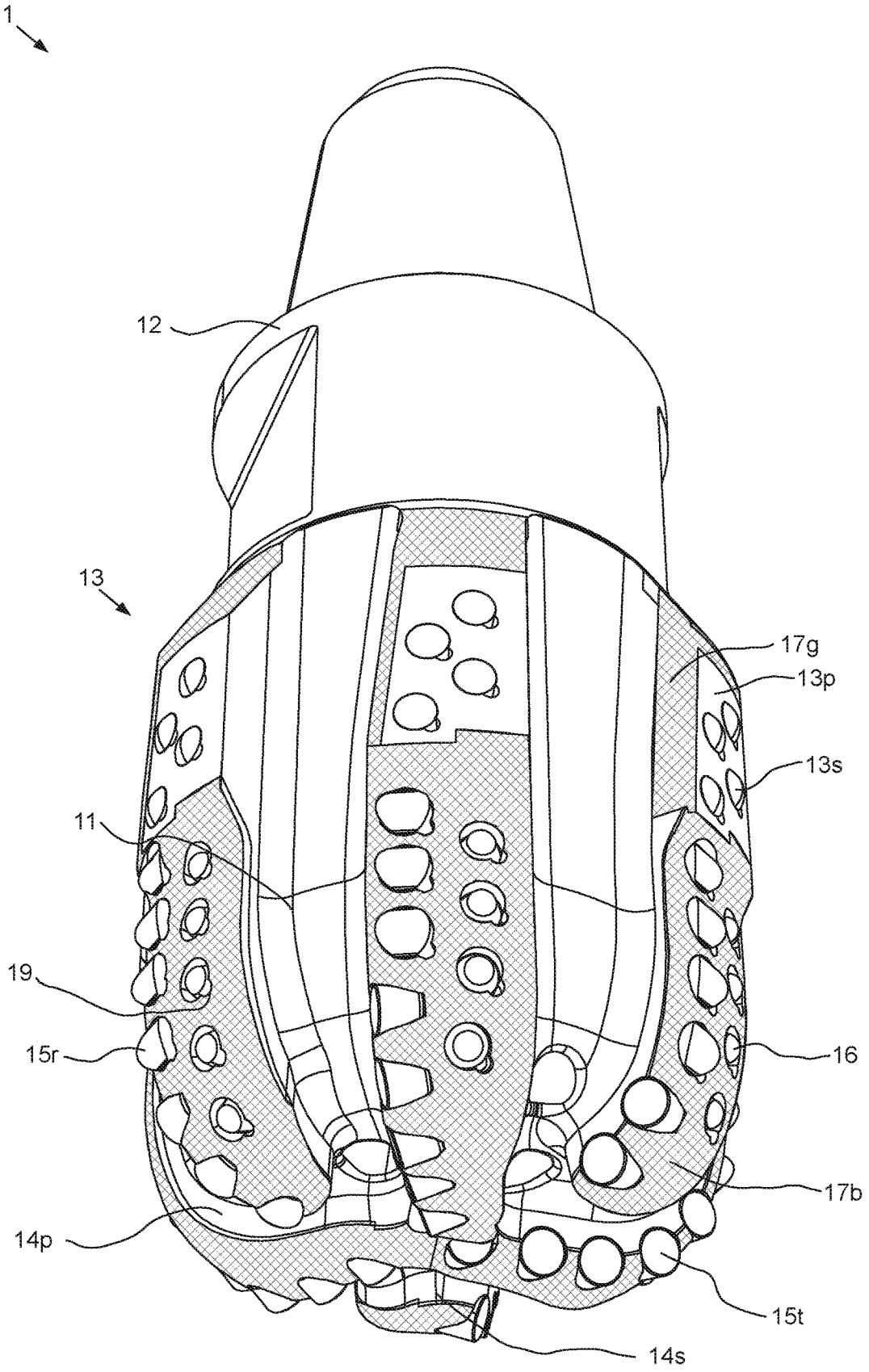
FIG. 2 illustrates the fixed cutter completions bit.
Figure 3:
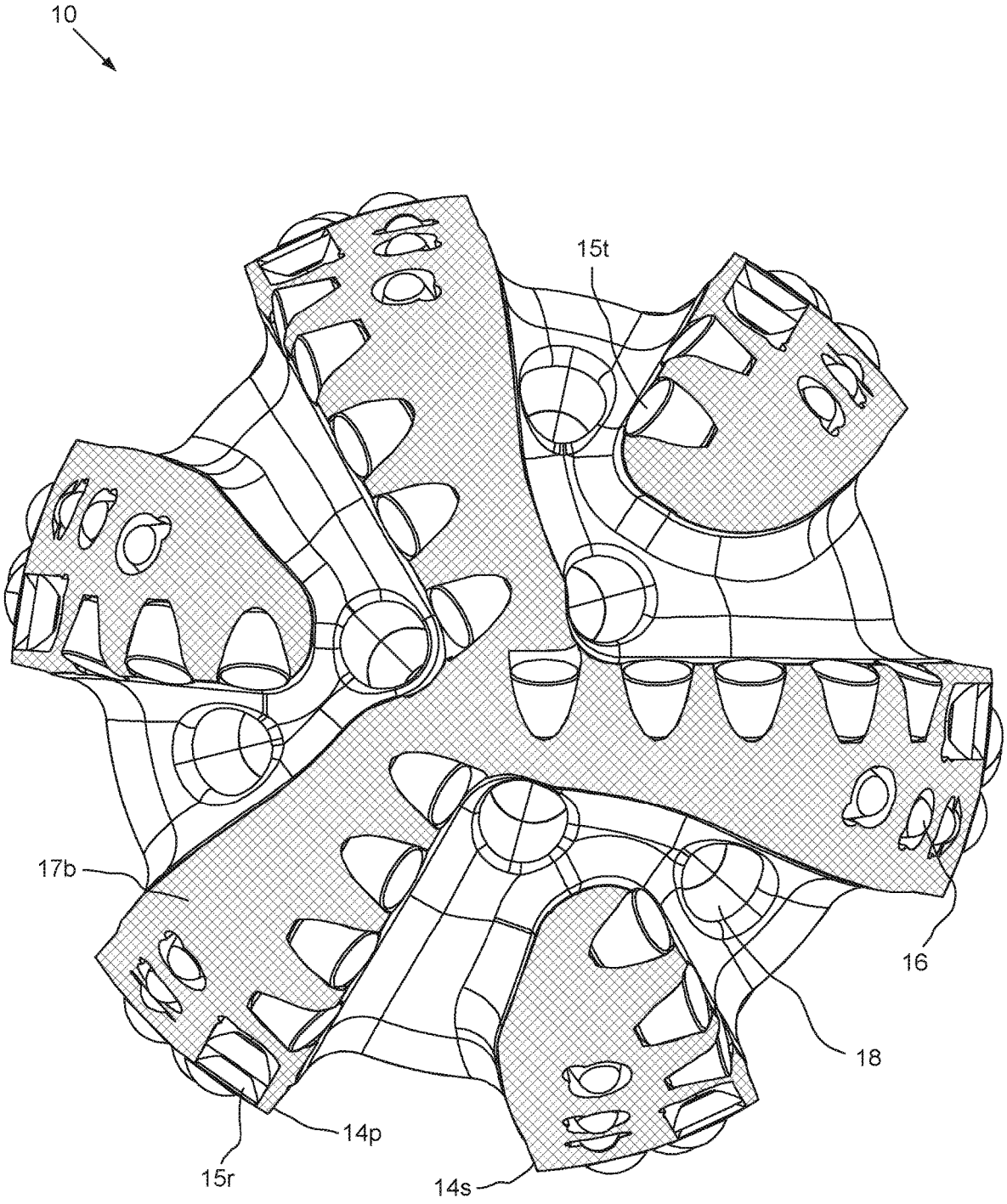
FIG. 3 illustrates a cutting face of the fixed cutter completions bit.
Figure 4:
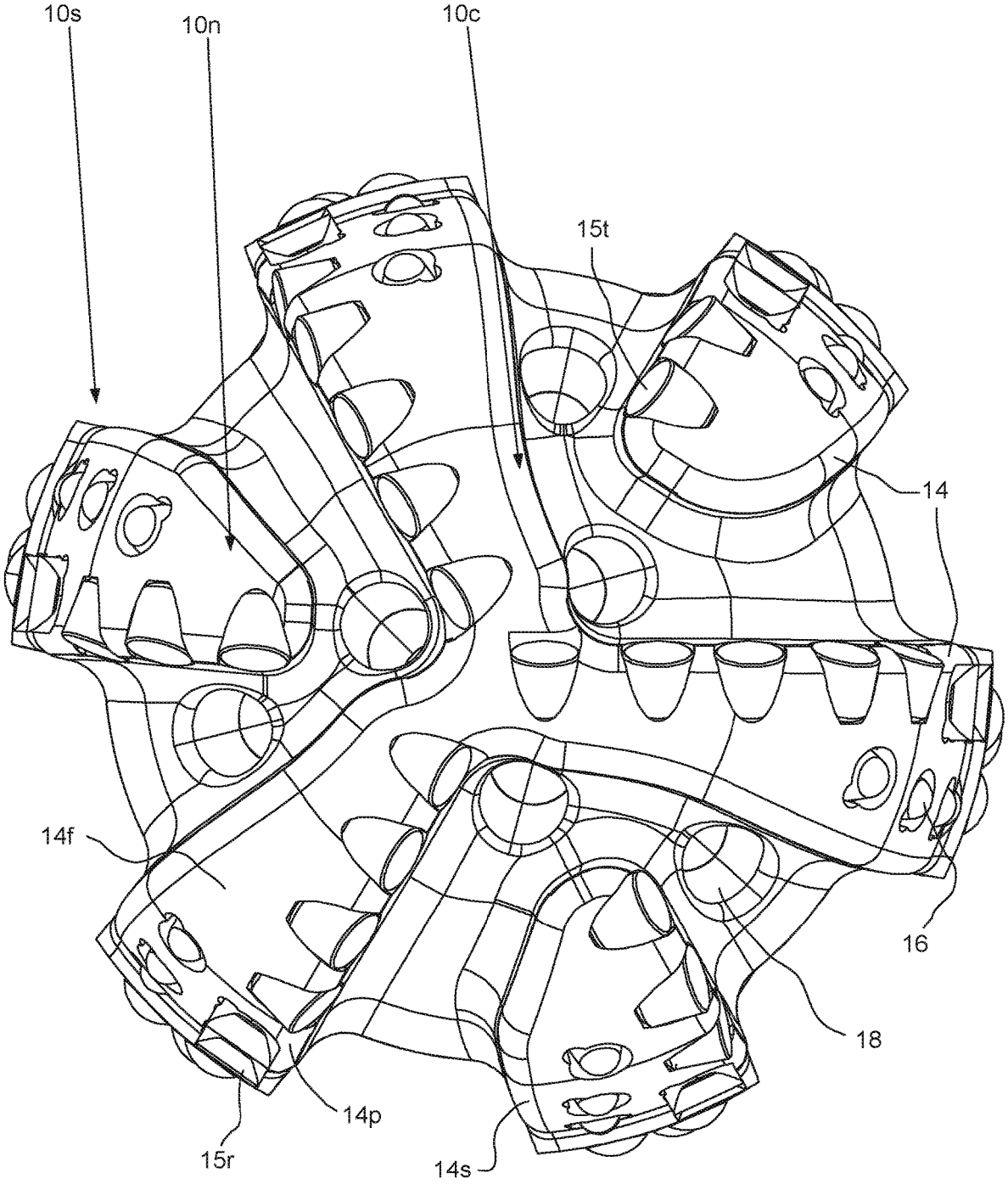
FIG. 4 illustrates the cutting face before dressing.
Figure 5:
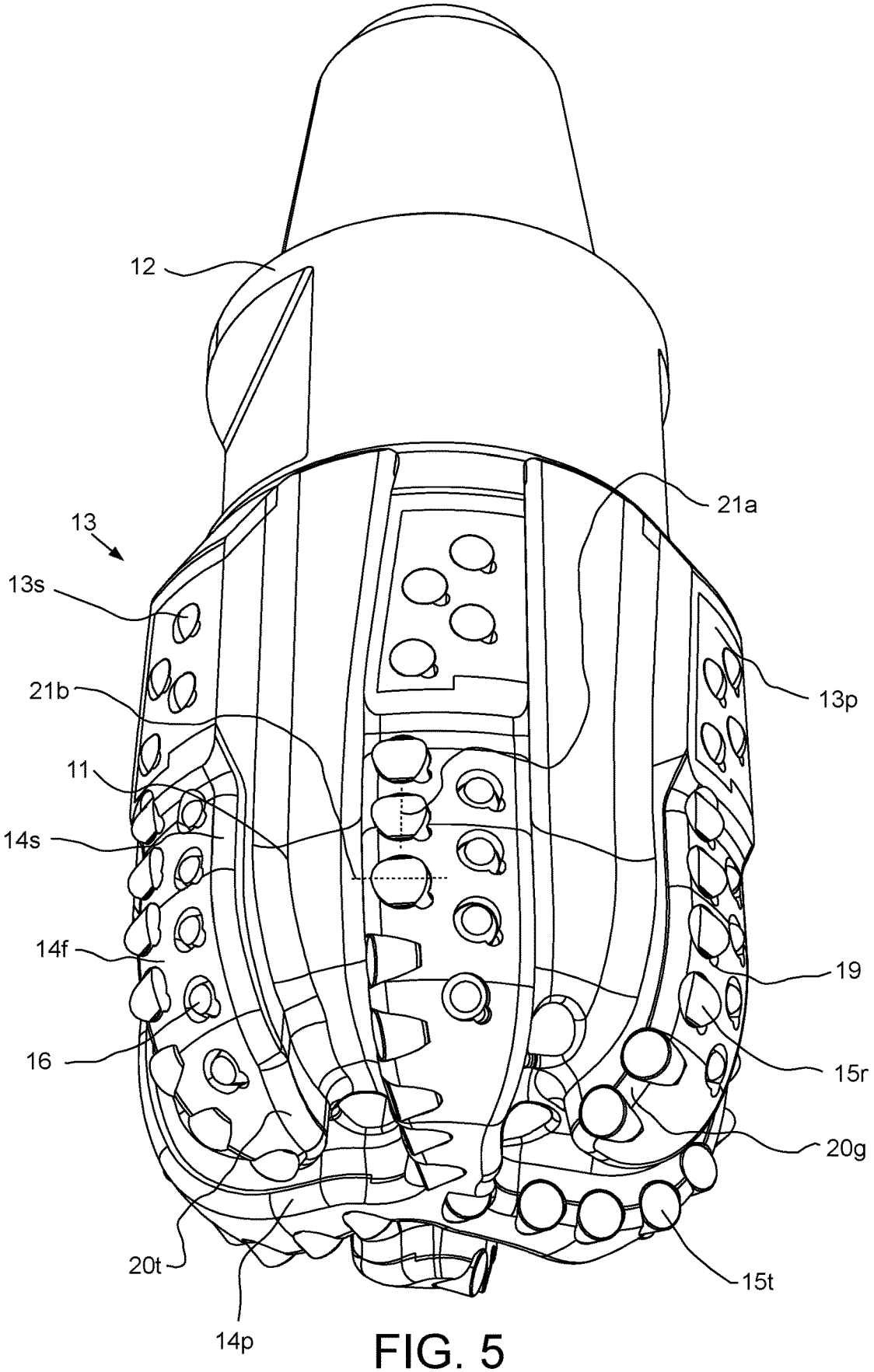
FIG. 5 illustrates the fixed cutter completions bit before dressing.

FIG. 2 illustrates the fixed cutter completions bit 1. FIG. 3 illustrates a cutting face 10 of the fixed cutter completions bit 1. FIG. 4 illustrates the cutting face before dressing. FIG. 5 illustrates the fixed cutter completions bit before dressing. The completions bit 1 may include the cutting face 10, a bit body 11, a shank 12, and a gage section 13. The bit body 11 may be metallic, such as being made from steel. The metallic bit body 11 may be connected to the shank 12 by threaded couplings and then secured by a weld or the metallic bit body may be monoblock having an integral body and shank.

The shank 12 may be tubular and made from a metal or alloy, such as steel, and have a coupling, such as a threaded pin, formed at an upper end thereof for connection of the completions bit 1 to the drilling motor. The shank 12 may have a flow bore formed therethrough and the flow bore may extend into the bit body 11 to a plenum (not shown) thereof. The cutting face 10 may form a lower end of the completions bit 1 and the gage section 13 may form at an outer portion thereof. The cutting face 10 may include one or more (three shown) primary blades 14*p*, one or more (three shown) secondary blades 14*s*, fluid courses formed between the blades, leading cutters 15*r,t*, backup cutters 16, and mill pads 17*b*. The cutting face 10 may have one or more sections, such as an inner cone 10*c*, an outer shoulder 10*s*, and an intermediate nose 10*n* between the cone and the shoulder sections.

The blades 14 may be disposed around the cutting face 10 and each blade may be formed by milling of the bit body 11 and may protrude from a bottom and periphery of the bit body. The primary blades 14*p* and the secondary blades 14*s* may be arranged about the cutting face 10 in an alternating fashion. The primary blades 14*p* may each extend from a center of the cutting face, across a portion of the cone section 10*c*, across the nose 10*n* and shoulder 10*s* sections, and to the gage section 13. The secondary blades 14*s* may each extend from a periphery of the cone section 10*c*, across the nose 10*n* and shoulder 10*s* sections, and to the gage section 13. Each blade 14*p,s* may extend generally radially across the portion of the cone section 10*c* (primary only) and nose section 10*n* with a slight spiral curvature and across the shoulder section 10*s* radially and longitudinally with a slight helical curvature. Each blade 14 may have a bearing face 14*f* extending between a leading edge 20*g* and a trailing edge 20*t* thereof. Each blade 14 may be made from the same material as bit body 11.

Each blade 14 may have a row of the leading cutters 15*r,t* disposed there-along. The leading cutters 15*t* may be tangentially oriented and may be arranged along the cone 10*c* and nose 10*n* sections of the blades 14 and along a first portion of the shoulder section 10*s* thereof. As used herein, tangentially oriented means that a through axis of each leading cutter 15*t* is parallel or substantially parallel to the bearing face 14*f* of the respective blade 14 at the location of the leading cutter and may include back rake or forward rake angles of less than or equal to thirty degrees. The through axis may be the longitudinal axis of the leading cutter 15*t* when the thickness of the cutter is greater than the diameter of the cutter. The first portion of the shoulder section 10*s* may be located adjacent to the nose section 10*n*. The leading cutters 15*t* may be pre-formed, such as by sintering, (for example, hot pressing) and mounted, such as by brazing, in respective leading pockets formed in the bearing faces 14*f* of the blades 14 adjacent to the leading edges 20*g* thereof. Each leading cutter 15*t* may be cylindrical and made from a cermet. The cermet may be a carbide, such as tungsten carbide, cemented by a metal or alloy, such as cobalt. The working face of each leading cutter 15*t* may be devoid of superhard material, such as diamond. The entire completions bit 1 may be devoid of superhard material, such as diamond.

Alternatively, each leading cutter 15*t* may have a superhard cutting table or superhard cap, such as polycrystalline diamond, bonded to a cermet substrate. The superhard cutting table or cap may be non-leached. Alternatively, each leading cutter 15*t* may be made from a ceramic carbide instead of a cermet carbide. Alternatively, each leading cutter 15*t* may be made from a cermet impregnated with superhard material.

The leading cutters 15*r* may be radially oriented and may be arranged along a second portion of the shoulder section 10*s* of the blades 14. As used herein, radially oriented means that a through axis of each leading cutter 15*r* is perpendicular or substantially perpendicular to the bearing face 14*f* of the respective blade 14 at the location of the leading cutter and may include back rake or forward rake angles of less than or equal to thirty degrees. The second portion of the shoulder section 10*s* may be located adjacent to the gage section 13. The leading cutters 15*r* may be pre-formed, such as by sintering (for example, hot pressing), and mounted, such as by brazing, in respective leading pockets formed in the bearing faces 14*f* of the blades 14 in proximity to the leading edges 20*g* thereof. Each leading cutter 15*r* may be made from any of the materials, discussed above, for the leading cutters 15*t*.

Each leading cutter 15*r* may have a cylindrical base portion mounted in the respective leading pocket and a working portion protruding from the respective pocket. The working portion of each leading cutter 15*r* may include a convex end face and a cylindrical side. Each leading cutter 15*r* may have the convex face across a first transverse axis 21*a* and a straight profile across a second transverse axis 21*b*, thereby having an asymmetric working portion. The working portion of each leading cutter 15*r* may be devoid of superhard material, such as diamond. Each blade 14 may have a vent 19, such as a hole, formed in the bearing face 14*f* thereof adjacent to each leading pocket of the respective leading cutter 15*r*. During brazing of each leading cutter 15*r*, the respective vent 19 may allow the leading cutter to fully seat into the respective pocket by allowing excess braze material to be expelled from the pocket through the vent. During mounting, a technician or robot may also use each vent 19 to properly orient the respective leading cutter 15*r* such that the first transverse axis 21*a* is parallel to the leading edge 20*g* (at the location of the respective leading cutter 15*r*) of the respective blade 14. In the proper orientation, the cylindrical side of each leading cutter 15*r* may be located along the leading edge 20*g* of the respective blade 14 to smash the slips 6 while the convex working face engages an inner surface of the casing or liner 4 to stabilize the completions bit 1.

Alternatively, each leading cutter 15*r* may have a cylindrical base portion mounted in the respective leading pocket and a frusto-conical (with a dome shaped end) or chisel-shaped working portion protruding from the respective pocket. The leading cutters 15*r* of each blade 14 may include both the chisel and the conical types. Alternatively, each leading cutter 15*r* may be mounted in the respective pocket by interference fit. Alternatively, each leading cutter 15*r* may have a superhard cutting table or superhard cap, such as polycrystalline diamond, bonded to a cermet substrate. The superhard cutting table or cap may be non-leached. Alternatively, each leading cutter 15*t* may be made from a ceramic carbide instead of a cermet carbide. Alternatively, each leading cutter 15*r* may be made from a cermet impregnated with superhard material.

Starting in the nose section 10*n*, each blade 14 may have a row of backup pockets formed in the bearing face 14*f* thereof and extending therealong to the gage section 13. Each backup pocket may be formed in the respective blade 14 in proximity to a trailing edge 20*t* of the respective blade. Each backup pocket may be aligned with or staggered between an adjacent pair of respective leading pockets. The backup cutters 16 may be mounted into the backup pockets by brazing. The backup cutters 16 may be radially oriented. Each backup cutter 16 may have a cylindrical base portion mounted in the respective backup pocket and a frusto-conical working portion protruding from the respective pocket. Each backup cutter may be made from any of the materials, discussed above, for the leading cutters 15*r,t*. The working portion may have a dome shaped end. The working portion of each backup cutter 16 may be devoid of superhard material, such as diamond. Each blade 14 may have another vent 19 formed in the bearing face 14*f* thereof adjacent to each backup pocket of the respective backup cutter 16.

Alternatively, each backup cutter 16 may have a chisel-shaped working portion protruding from the respective pocket or the convex shape of the leading cutters 15*r*. Alternatively, each backup cutter 16 may be mounted in the respective pocket by interference fit.

Figure 6A:
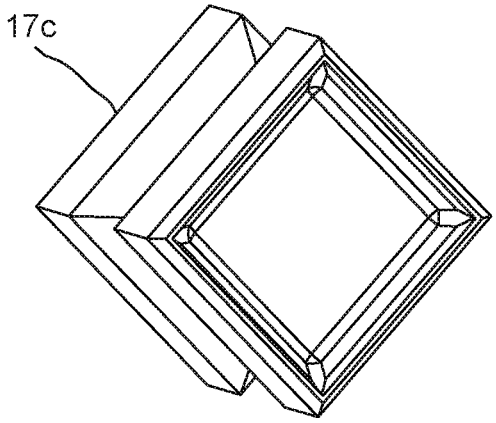
FIGS. 6A-6C illustrates a typical mill cutter of the fixed cutter completions bit.
Figure 6B:
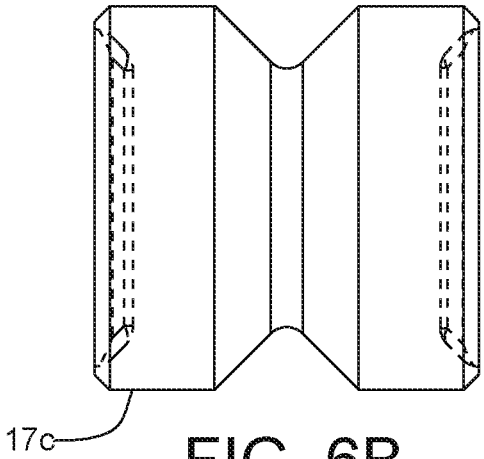
Figure 6C:
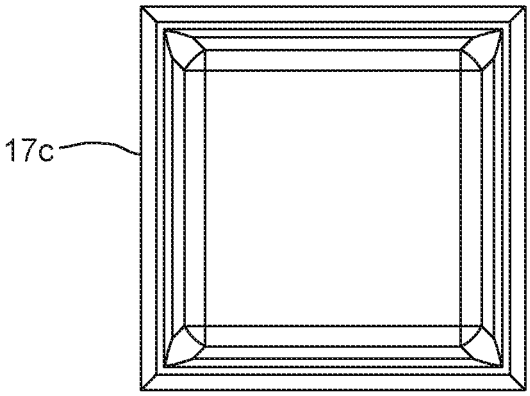

A mill pad 17*b* may be mounted to the bearing face 14*f* of each blade 14. Each mill pad 17*b* may cover the respective bearing face 14*f* (except for the portions thereof occupied by the cutters 15*r,t*, 16) along the cone 10*c* (primary blades only), nose 10*n*, and shoulder 10*s* sections thereof. Each mill pad 17*b* may also cover the leading 20*d* and trailing 20*t* edges of the respective blade 14 and may cover a portion of the leading and trailing faces of the respective blade. Each mill pad 17*b* may include a plurality of mill cutters 17*c* (FIGS. 6A-6C). Each mill pad 17*b* may be devoid of superhard material, such as diamond.

One or more (six shown) ports 18 may be formed in the bit body 11 and each port may extend from the plenum and through the bottom of the bit body to discharge milling fluid (not shown) along the fluid courses and junk slots. Each port 18 may be unlined. The ports 18 may include an inner set of one or more (three shown) ports disposed in the cone section 10*c* and an outer set of one or more (three shown) ports disposed in the nose section 10*n* and/or shoulder section 10*s*. Each inner port 18 may be disposed between an inner end of a respective secondary blade 14*s* and the center of the cutting face 10.

Alternatively, a nozzle (not shown) may be disposed in each port 18 and fastened to the bit body 11. Each nozzle may be fastened to the bit body 11 by having a threaded coupling formed in an outer surface thereof and each port may be modified to include a threaded socket for engagement with the respective threaded coupling.

The gage section 13 may define a gage diameter of the bit 1. The gage section 13 may include a plurality of gage pads 13*p*, such as one gage pad for each blade 14, junk slots formed between the gage pads, stabilizers 13*s*, and mill pads 17*g*. The junk slots may be in fluid communication with the fluid courses formed between the blades 16. The gage pads 13*p* may be disposed around the gage section 13 and each pad may be formed during milling of the bit body 11 and may protrude from a periphery of the bit body. Each gage pad 13*p* may be made from the same material as the bit body 11 and each gage pad may be formed integrally with a respective blade 14. Each gage pad 13*p* may extend upward from an end of the respective blade 14 in the shoulder section 10*s* to an exposed outer surface of the shank 12. Each gage pad 13*p* may include a transition portion located adjacent to the shoulder section 10*s*, a full diameter portion extending from the transition portion, and a tapered portion extending from the full diameter portion to the shank 12.

The full diameter portion of each gage pad 13*p* may have a set (four shown) of pockets formed in a bearing face thereof. A stabilizer 13*s* may be mounted in each pocket of the full diameter portion. Each stabilizer 13*s* may be mounted into the respective pocket by brazing. Positions of the stabilizers 13*s* may be staggered across the gage pads 13*p* to obtain complete coverage. Each stabilizer 13*s* have a cylindrical base portion mounted in the respective pocket and a dome-shaped working portion protruding from the respective pocket. Each stabilizer 13*s* may be made from a metal, alloy, polymer, or composite, such as a cermet. Each gage pad may have a vent 19 formed in the bearing face thereof adjacent to each pocket of the respective stabilizer 13*s*.

A mill pad 17*g* may be mounted to a leading face of each gage pad 13*p*. Each mill pad 17*g* may cover the respective leading face along a length of the full diameter portion and tapered portion of the respective gage pad 13*p*. Each mill pad 17*g* may include a plurality of the mill cutters 17*c*. Each mill pad 17*g* may be devoid of superhard material, such as diamond. Each mill pad 17*g* may also cover the transition and tapered portions of the respective gage pad 13*p* and a leading edge thereof.

Alternatively, each stabilizer 13*s* may be mounted in the respective pocket by interference fit. Alternatively, the tapered portion of each gage pad 13*p* may have a pocket formed adjacent to or in proximity to a leading edge thereof. An up-drill cutter may be mounted in each pocket of the tapered portion. Each up-drill cutter may be mounted into the respective pocket by brazing or interference fit. The up-drill cutters may be a similar to either the tangential leading cutters 15*t* or the radial leading cutters 15*r*, discussed above. Positions of the up-drill cutters may be staggered across the tapered portions of the gage pads 13*p* to obtain complete and overlapping coverage.

FIGS. 6A-6C illustrate typical one of the mill cutters 17*c*. The typical mill cutter 17*c* may have any pre-defined multi-edged shape and a minimum dimension greater than or equal to one-eighth of an inch (three millimeters), three-sixteenths of an inch (five millimeters), or one-quarter of an inch (six millimeters). As used herein, the minimum dimension is the minimum of one of the three major dimensions (length, width, and height). The multi-edged shape may be a block, such as a cubic block, of cermet material. The cermet material may be a cemented carbide including a binder and carbide, such as cobalt-tungsten carbide. The cermet material may be formed into the block by sintering, such as hot pressing.

The mill cutter 17*c* may have a pair of opposite rectangular sides and four profiled sides connecting the rectangular sides. The profiled sides may each have rectangular end portions located adjacent to the respective rectangular sides and profiled mid portions connecting the respective end portions. Each rectangular end portion may have chamfered corners adjacent to the respective rectangular sides. Each profiled portion may have a pair of opposed trapezoidal portions converging from the respective end portions toward a center of the mill cutter 17*c*. Each profiled portion may further have a filleted rectangular center portion connecting ends of the trapezoidal portions distal from the respective end portions. Each rectangular side may have a raised peripheral portion and a recessed interior portion. Tapered walls may connect each raised peripheral portion to the respective interior portion. Each corner of the tapered walls may be shaved.

Alternatively, the multi-edged shape may have a different shape than cubic or even rectangular, such as any polygonal shape, for example, star-shaped or triangular-shaped.

Each mill cutter 17*c* may occupy only a small fraction of a surface of the respective mill pad 17*b,g* such that many mill cutters are necessary to dress the surface, such as greater than or equal to ten, twenty, or thirty mill cutters. The mill cutters 17 may be mounted to the respective blades 14 or gage pads 13*p*, such as by brazing. Each mill cutter 17*c* may have a random orientation in the respective mill pad 17*b,g*. To facilitate the brazing operation, several mill cutters 17*c* may be combined in a rod (not shown) with a tinning binder which allows a welder (person or robot) to rapidly braze the cutters on the surfaces.

Alternatively, each mill cutter 17*c* may be a crushed cermet particle, such as cobalt-tungsten carbide, and the mill cutters may be bonded to the blades 14 and gage pads 13*p* by a high strength metal or alloy, such as a copper alloy. Each mill cutter 17*c* may have a minimum dimension greater than or equal to one-eighth of an inch (three millimeters), three-sixteenths of an inch (five millimeters), or one-quarter of an inch (six millimeters). The mill cutters 17*c* and bonding material may be procured as composite rods and deposited onto the blades 14 and gage pads 13*p* by oxyacetylene welding. The alternative mill cutters are also discussed and illustrated in U.S. 62/750,567, filed on Oct. 25, 2018, with attorney docket number VT-18-019, which is herein incorporated by reference in its entirety (see mill cutters 23 and matrix material 24).

Advantageously, PDC bits that have been used to drill out frac plugs 2 have shown shoulder durability issues and have shown damage to the shoulder region of the bit. The fixed cutter completions bit 1 has increased durability in the shoulder region of the bit and increased cutting efficiency by utilizing multiple types of cutters. The radially oriented cutters 15*r*, 16 in the outer portion of the cutting face 10 (especially in the shoulder section 10*s*) increase durability and dislodge and destroy slips 6 and any other hard elements of the frac plug 2. Use of the cermet cutters 15*r,t*, 16 instead of PDC cutters throughout the cutting face 10 increase durability and speed of drilling through the frac plugs 2. The mill pads 17*b,g* ensure that the cuttings size is small by secondary milling of cuttings to shred cuttings into smaller pieces. The gage mill pads 17*g* also shred any cuttings between the gage pads 13*p* and the casing 3. The stabilizers 13*s* at full bit diameter serve to stabilize the bit 1 inside of the casing 4 and protect the casing from damage by the cutting face 10. The tangential leading cutters 14*t* located in the inner portion of the cutting face 10 (especially the cone 10*c* and nose 10*n* sections) are well suited to target the softer composite materials in the frac plugs 2 and to shred the composite material. The radial leading cutters 14*r* are well suited to smash the harder materials of the frac plugs 2, such as the slips 6, while also stabilizing the tangential leading cutters 14*t*.

Alternatively, the completions bit 1 may be the completions bit disclosed and illustrated in the priority application (U.S. provisional application no. 62/692,134, filed on Jun. 29, 2018), which is herein incorporated by reference in its entirety. This alternative completions bit is similar to the completions bit 1 except for having two primary blades and five secondary blades, having frusto-conical (with domed ends) and chisel shaped radial leading and backup cutters, and having seven ports.

While the foregoing is directed to embodiments of the present disclosure, other and further embodiments of the disclosure may be devised without departing from the basic scope thereof, and the scope of the invention is determined by the claims that follow.

The invention claimed is:

1. A completions bit for use in a wellbore, comprising:
- a shank having a coupling formed at an upper end thereof;
- a body mounted to a lower end of the shank; and
- a cutting face forming a lower end of the bit and comprising:
  - a blade protruding from the body;
  - a tangentially oriented leading cutter mounted to a bearing face of the blade adjacent to a leading edge of the blade at an inner portion of the cutting face; and
  - a radially oriented leading cutter mounted to the bearing face of the blade in proximity to the leading edge thereof at an outer portion of the cutting face,
- wherein:
  - the inner portion of the cutting face is devoid of radially oriented leading cutters,
  - the outer portion of the cutting face is devoid of tangentially oriented leading cutters,
  - the cutting face has an inner cone section, an outer shoulder section, and an intermediate nose section,
  - the inner portion of the cutting face includes the cone and nose sections, and
  - the outer portion includes the shoulder section.

2. The completions bit of claim 1, further comprising a mill pad mounted to the bearing face of the blade, covering the bearing face along the inner and outer portions of the cutting face, and comprising a plurality of mill cutters, each mill cutter having a minimum dimension greater than or equal to ⅛th of an inch.

3. The completions bit of claim 2, wherein each mill cutter has a predefined multi-edged shape.

4. The completions bit of claim 2, wherein:
- each mill cutter is a crushed cermet particle, and
- the mill pad further comprises a metal or alloy binder.

5. The completions bit of claim 2, further comprising a gage section having:
- a gage pad protruding from the body;
- a plurality of stabilizers mounted to a bearing face of the gage pad; and
- a second mill pad mounted to a leading face of the gage pad, the second mill pad comprising a plurality of the mill cutters.

6. The completions bit of claim 5, wherein the blade is a primary blade extending from a center of the cutting face to the gage section.

7. The completions bit of claim 2, wherein working faces or working portions of the cutters and the mill pad are each made from a carbide material devoid of diamond.

8. The completions bit of claim 1, wherein:
- the cutting face further comprises a row of radially oriented trailing cutters mounted to the bearing face of the blade in proximity to a trailing edge thereof and extending along the shoulder section.

9. The completions bit of claim 1, wherein the body is made from steel.

10. The completions bit of claim 1, wherein the entire bit is devoid of diamond.

11. The completions bit of claim 1, wherein the tangentially oriented leading cutter is cylindrical and the radially oriented leading cutter is cylindrical with a convex working surface.

12. The completions bit of claim 11, wherein:
- the radially oriented leading cutter is asymmetrical,
- the convex working surface is across a first transverse axis of the radially oriented leading cutter, and
- the radially oriented leading cutter is oriented with the first transverse axis parallel to the leading edge of the blade.

13. The completions bit of claim 12, wherein:
- the radially oriented leading cutter has a straight profile across a second transverse axis, and the radially oriented leading cutter has cylindrical side located along the leading edge of the blade.

14. The completions bit of claim 11, wherein the cutting face further comprises a plurality of the tangentially oriented leading cutters extending across the inner portion of the cutting face and a plurality of the radially oriented leading cutters extending along the outer portion of the cutting face.

15. A method of drilling out a plug using the completions bit of claim 1, comprising:

assembling the completions bit as part of a mill string;

deploying the mill string into a casing or liner string set in the wellbore to the plug set in the casing or liner string; and injecting milling fluid through the mill string, rotating the completions bit, and engaging the completions bit with the plug, thereby drilling out the plug.

16. A completions bit for use in a wellbore, comprising:

a shank having a coupling formed at an upper end thereof;

a body mounted to a lower end of the shank; and a cutting face forming a lower end of the bit and comprising:

a blade protruding from the body;

a tangentially oriented leading cutter mounted to a bearing face of the blade adjacent to a leading edge of the blade at an inner portion of the cutting face; and a radially oriented leading cutter mounted to the bearing face of the blade in proximity to the leading edge thereof at an outer portion of the cutting face, wherein:

the tangentially oriented leading cutter is cylindrical, the radially oriented leading cutter is cylindrical with a convex working surface, the radially oriented leading cutter is asymmetrical, the convex working surface is across a first transverse axis of the radially oriented leading cutter, and the radially oriented leading cutter is oriented with the first transverse axis parallel to the leading edge of the blade.

17. The completions bit of claim 16, wherein:

the radially oriented leading cutter has a straight profile across a second transverse axis, and the radially oriented leading cutter has cylindrical side located along the leading edge of the blade.

* * * * *